US006860181B2

(12) United States Patent
Aubourg et al.

(10) Patent No.: US 6,860,181 B2
(45) Date of Patent: Mar. 1, 2005

(54) AUTOMATED MANUFACTURING APPARATUS FOR ALUMINIUM WINDOW/ DOOR SYSTEMS

(75) Inventors: Peter Aubourg, Kirrawee (AU); Ross Doonan, Wilton (AU); Peter Donnelly, Illawong (AU)

(73) Assignee: Trend Windows & Doors Pty Limited (AU)

( * ) Notice: Subject to any disclaimer, the term of this patent is extended or adjusted under 35 U.S.C. 154(b) by 181 days.

(21) Appl. No.: 09/747,126

(22) Filed: Dec. 22, 2000

(65) Prior Publication Data

US 2002/0033236 A1 Mar. 21, 2002

(30) Foreign Application Priority Data

Aug. 3, 2000 (AU) ..... PQ9166

(51) Int. Cl.[7] ..... B23P 21/00

(52) U.S. Cl. ..... 83/102; 83/155; 209/684; 29/469

(58) Field of Search ..... 83/23, 29, 84, 83/86, 89, 94, 102, 151, 155, 161, 167; 144/2, 1; 156/499; 29/429, 430, 431, 469; 209/659, 660, 684, 685; 414/788.7; 53/154, 155

(56) References Cited

U.S. PATENT DOCUMENTS

| | | | | |
|---|---|---|---|---|
| 2,662,563 A | * | 12/1953 | Grove | 144/2.1 |
| 3,996,723 A | * | 12/1976 | Greenwell | 53/500 |
| 4,309,600 A | | 1/1982 | Perry et al. | |
| 4,870,592 A | | 9/1989 | Lampi et al. | |
| 4,991,706 A | | 2/1991 | Kitamura | |
| 5,084,829 A | | 1/1992 | Kato | |
| 5,125,149 A | | 6/1992 | Inaba et al. | |
| 5,349,730 A | * | 9/1994 | Anderson et al. | 29/24.5 |
| 5,355,579 A | | 10/1994 | Miyasaka et al. | |
| 5,374,231 A | | 12/1994 | Obrist | |
| 5,446,669 A | | 8/1995 | Yamashita et al. | |
| 5,617,706 A | * | 4/1997 | Hartman et al. | 83/236 |
| 5,736,000 A | * | 4/1998 | Sturtz | 156/499 |
| 5,793,663 A | | 8/1998 | Ng et al. | |
| 5,809,893 A | * | 9/1998 | Gamperling et al. | 101/483 |
| 5,810,487 A | * | 9/1998 | Kano et al. | 400/83 |
| 6,086,703 A | * | 7/2000 | Sturtz | 156/499 |
| 6,294,044 B1 | * | 9/2001 | Schwaiger et al. | 156/304.2 |

FOREIGN PATENT DOCUMENTS

| | | | |
|---|---|---|---|
| AU | B 34847 | | 5/1979 |
| AU | A-83566 | | 5/1982 |
| AU | B 68770 | | 8/1987 |
| AU | B 90882 | | 12/1991 |
| AU | B 89803 | | 6/1992 |
| AU | B 19550 | | 10/1995 |
| AU | A-20574 | | 12/1995 |
| AU | A 20576 | | 12/1995 |
| AU | A 19069 | | 10/1997 |
| DE | 2902-197 | | 7/1979 |
| DE | 211509 | | 7/1984 |
| DE | 3721861 | * | 1/1989 |
| EP | 47056 | | 3/1982 |
| EP | 74288 | | 3/1983 |
| EP | 259-892 A | | 3/1988 |
| EP | 0 485 987 A1 | | 5/1992 |
| FR | 2488177 | | 2/1982 |
| GB | 2223-332 A | | 4/1990 |

(List continued on next page.)

*Primary Examiner*—Stephen Choi
(74) *Attorney, Agent, or Firm*—Knobbe Martens Olson & Bear LLP

(57) ABSTRACT

The present invention relates to the automated manufacture of frame components for window assemblies and the like. More particularly the invention includes: an automated apparatus for collating kits of frame components; an automated manufacturing system incorporating a collating device of this kind; and a frame components finishing operations station adapted for operation as part of the automated manufacturing system.

5 Claims, 10 Drawing Sheets

FOREIGN PATENT DOCUMENTS

| | | |
|---|---|---|
| JP | 7291745 | 11/1995 |
| JP | 8318452 | 12/1996 |
| WO | 8203-995 | 11/1982 |
| WO | WO 8807-490 A | 10/1988 |
| WO | WO 90/03617 | 4/1990 |
| WO | WO 93/07990 | 4/1993 |
| WO | WO 93/25945 | 12/1993 |
| WO | WO 93/25948 | 12/1993 |
| WO | WO 94/01241 | 1/1994 |
| WO | WO 94/11151 | 5/1994 |
| WO | WO 95/09387 | 4/1995 |
| WO | WO 95/26522 | 5/1995 |
| WO | WO 95/30937 | 11/1995 |
| WO | WO 96/27825 | 9/1996 |
| WO | WO 96/28278 | 9/1996 |
| WO | WO 96/36458 | 11/1996 |
| WO | WO 97/12335 | 4/1997 |
| WO | WO 97/21518 | 6/1997 |
| WO | WO 97/26588 | 7/1997 |
| WO | WO 99/43462 | 9/1999 |

* cited by examiner

AUTOMATED MANUFACTURING APPARATUS FOR ALUMINIUM WINDOW/ DOOR SYSTEMS

FIELD OF THE INVENTION

The present invention relates to the automated manufacture of frame components for window assemblies and the like. More particularly the invention includes: an automated apparatus for collating kits of frame components; an automated manufacturing system incorporating a collating device of this kind; and a frame components finishing operations station adapted for operation as part of the automated manufacturing system.

BACKGROUND OF THE INVENTION

The invention has been developed primarily for use in the manufacture of window or door components made from extruded aluminium or PVC sections and will be described hereinafter with reference to this field of use. However, it will be appreciated by those skilled in the art that the invention is equally applicable to the collation and manufacture of kits of window or door frame elements made from other materials including wood, or even kits of other frame elements such as wall and roof frames, wherein the various components are made from stock lengths of timber or other sections.

In most cases, the commercial manufacture of aluminium window and door frame components from stock aluminium extrusions has been an extremely slow and labour intensive process with unacceptably long lead times. Further, the prior art processes have generally required high inventory levels which add significantly to production costs.

For example, a fairly typical manufacturing procedure would include the following steps. Firstly, large quantities of the aluminium extrusions would be powder coated at the main manufacturing plant and loaded into skips for distribution to the retail window fabricators. These skips are then put into inventory by the fabricators. On receipt of an order to the fabricators, the relevant extrusions would be taken out from storage and then manually cut up to length as per the order requirements. The cut lengths would then be loaded into some form of trolley for transfer to another areas where the ends of the cut lengths would be machined as necessary. The machined cut components would then be loaded into a bin as a kit of components which would then be transferred to the assembly tables where the frames (and sashes if required) would be separately assembled and then joined as a complete window/door system.

As will be appreciated, this prior art procedure requires a significant amount of man handling of the various stock items, high inventory levels and typical lead times of about 2–3 weeks. These factors add significantly to the overall cost. Further, the long lead times mean that there is no flexibility should a builder need to change his schedule due to bad weather or the like, as the sequencing of window orders can not be varied once the job has commenced.

To date automation of this manufacturing process has not been attempted due to the difficulties associated with the handling of components of both vastly differing lengths (eg. 220 mm to 2700 mm) as well as differing cross sectional shape. While there are numerous automated manufacturing systems available or currently in use for machining other products, none of these are readily adaptable for use with frame components having such varying size and shape characteristics. Further, none of these prior art systems have a kit forming collating capability.

It is an object of each aspect of the present invention to respectively provide: a frame component collator; an automated frame component manufacturing process and apparatus; and a frame components finishing operations station; which will each overcome or at least ameliorate one or more of the relevant above discussed disadvantages of the prior art, or at least offer a useful alternative.

DISCLOSURE OF THE INVENTION

Collating Apparatus

According to a first aspect of the invention there is provided a collator for grouping finished frame components of varying lengths and cross sectional shape into kits, said collator including:

a frame component receiving station;

a collator station defining a plurality of collating receptacles each adapted to receive a kit of said frame components; and first transfer means to selectively transfer each of said frame components from said receiving station to a predetermined one of said receptacles of said collating station.

The term frame is used herein to include window sash components and other longitudinal building elements.

In one preferred form the frame component receiving station and first transfer means are combined in the form of a programmable distributor conveyor that receives the finished frame components and then selectively deposits each of them into a predetermined one of the collator receptacles.

Preferably, the collator station is in the form of a carousel having thereon a plurality of collating bins each adapted to receive a set of frame components required to make up a kit for a particular frame.

More preferably, the carousel contains two sets of collating bins desirably each in the form of a row of component receiving pockets, each row being mounted 180° apart, the carousel being rotatable about an axis between said sets of pockets. This enables one set of pockets to be positioned for loading or receiving the frame components, while the other set is positioned for unloading of the collated kits of components for subsequent packaging or distribution, thereby facilitating approximately continuous operation.

In one preferred form the sets of pockets are disposed in a generally vertical orientation for loading and unloading of the frame components. Desirably, each set of pockets is also mounted for horizontal movement toward each other in preparation for and during the rotation cycle and away from each other for repositioning for the loading and unloading cycles.

Desirably, each collating pocket comprises a sling style holder which on the carousel is inclined slightly to the vertical to receive the frame elements from the holding conveyor. Preferably, these sling style holders are readily removable from the collator manually or by robot or the like, to facilitate simple transfer or emptying of the grouped frame elements for subsequent packaging.

In another form, the collator comprises a series of slide tables, each adapted to receive thereon a plurality of frame components required to form a kit, the components being transferred to said tables by first transfer means in the form of a suitable distributor conveyor arrangement, sorting robot system or the like. As each new kit component is delivered to an edge of a table, the existing components on the table are simultaneously pushed further onto the table until the requisite parts in a particular kit have been accrued.

In one particularly preferred form, the distributor conveyor is oriented to receive and convey the finished frame components in a generally vertical orientation, the preferred configuration being arranged to carry the frame components at an angle of approximately 15° off vertical such that the side adjacent the preparation lines is inclined outwardly toward the base (ie. away from the preparation line) to assist the step of receiving the finished components and on the remote side is inclined outwardly at a top end (ie. toward the carousel) to assist release of the frame components into the collator receptacles or pockets.

Automated Manufacturing System

According to a second aspect of the invention there is provided an automated manufacturing system for manufacturing kits of frame components from stock lengths of frame sections, said apparatus including:

at least one frame component preparation line; and a collating station for grouping said frame components into kits;

said frame component preparation line including;

a first cutting station adapted to cut said stock lengths of frame sections to predetermined cut lengths for forming into frame components; and first conveyor means to transfer said cut frame sections to said collating station for grouping into kits.

Preferably, the preparation line also includes an infeed accumulator adapted to receive, store and feed singularly in series stock lengths of longitudinal frame sections to the cutting station.

Desirably, the manufacturing apparatus includes two or more frame component preparation lines.

Preferably, one or more of the frame component preparation lines includes a finishing operations station adapted to form, punch and/or machine one or both ends of said cut frame sections, and optionally positions therebetween, to thereby form into said finished frame components.

In one embodiment, one or more dedicated ends only operations stations are provided and one or more of the frame component preparation lines may also include a dedicated centre operation station for forming, punching or otherwise machining said cut frame sections at locations between the ends thereof.

Preferably, each of said one or more frame component preparation lines includes means to transfer the finished frame components from the respective frame component preparation line to the collating station.

In one form the means to transfer the finished frame components comprises a stand up mechanism which picks up the preferably horizontally oriented finished frame components from the end of the frame component preparation line and rotates them through 180° for presentation to the distributor conveyor which is configured to receive the finished frame components in a generally vertically orientation. In one particularly preferred form, twin conveyors are provided at the end of the frame component preparation line which are mounted on a shuttle, such that the stand up mechanism operates only every second cycle to simultaneously stand up, invert and place two frame components onto the distributor conveyor.

Preferably, the collating station is a collator in accordance with the first aspect of the invention which in the preferred form is adapted to receive finished frame components from one or more frame component preparation lines.

Preferably, the entire manufacturing apparatus is programmable working on a zone transfer principle. Desirably, the apparatus also includes control means to optimise material usage and work flow through the system, to minimise production times and material wastage. In one form the system is fully PLC controlled and the tooling configured to facilitate resetting (where necessary) for different frame components through simple selection of alternative programs. In one preferred form the apparatus is divided into separate modules each being controlled by a separate PLC, these individual PLCs being monitored by a central PC. This form of modularisation enables more efficient maintenance and trouble shooting and minimises machine down time.

In one preferred form, the first cutting station includes means to longitudinally index the stock length of frame section to a predetermined location for cutting in a straight cut or mitre cut as required, as well as transfer means to transfer the cut length of frame section to the first conveyor means.

In one embodiment each end operating station includes transfer means to index the cut lengths of frame section in a direction firstly transverse, then parallel, to that of the first conveyor means in a square wave formation away from the conveyor to a first of series of sub-stations at which separate end operations can be formed progressively on one respective end of a cut length of frame section. The station also includes means to then transfer the cut length to a second series of sub-stations for equivalent operations on the opposing end of the cut frame sections. Desirably, the sub-stations include a plurality of punches, forming tools, drills or the like, as required. Preferably, a plurality of indexable tools are provided at each sub-station to thereby facilitate a wide range of operations without the need to shut down the apparatus for tooling changes.

Preferably, a packing station is provided downstream of the collator or collating station which is fed manually, automatically from the collator or by dedicated transfer robot or the like.

Desirably, the automated frame manufacturing apparatus of the first aspect includes a collator in accordance with the second aspect of the invention.

In one preferred form, the automated manufacturing apparatus includes four parallel frame element preparation lines which all feed to a collating station comprising one distributor conveyor which in turn feeds two carousel arrangements.

Finishing Operations Station

According to a third aspect of the invention there is provided a preferred frame components finishing operations station adapted for operation as part of an automated frame component manufacturing system, said finishing operations station including:

one or more set up zones;

at least one finishing operations zone;

means to selectively infeed cut lengths of frame section to said set up zones;

transport means adapted to grip said cut lengths in said set up zone, register the gripped lengths against a fixed datum, and feed said gripped lengths to, from, and within said finishing operations zone;

at least one operations means adapted to machine, form, punch or otherwise operate on said cut lengths located in said machining zone;

means to outfeed finished components from said set up zones; and control means to track the location of parts within the various zones, optimise zone usage, and, when required, synchionise infeed and outfeed from the station with the cycle times of an associated automated frame component and manufacturing system.

The term "finished component" above is used to denote components on which operations conducted within the operation station have been completed, and thereby does not exclude components that may still require subsequent operations before being deemed a fully completed component.

Preferably, the station also includes one or more holding zones for storing components before or after processing in the operations zone. This provides a buffer that assists the control means in being able to optimise usage of the set up and operations zone and more importantly, in the synchronisation of the infeed and outfeed to and from the station within the cycle times of an associated frame component manufacturing system.

In the preferred embodiment the operations means is in the form of a machining system located within a machining zone.

Preferably there are at least two set up zones. More preferably there are an even number of set up zones configured in pairs and serially disposed with an operations or machining zone therebetween, the machining zone being configured to enable passage of the cut lengths through from a first of said pair of set up zones to the corresponding second of said set up zones. In this manner the frame components are processed by:

feeding of the component to a first of said set up zones;

subsequently gripping the component within the set up zone and accurately setting it up against fixed predetermined datums; and then machining the frame components at predetermined locations by progressive step wise passage of the component through the machining zone and on to the adjacent second paired set up zone. Each serial pair of set up zones and machining zone may be referred to as a line.

This line configuration where the component passes through the machining zone readily facilitates the machining of components having drastically varying lengths. It also enables a machined component to be removed from the second set up zone, while a new component is simultaneously set up, gripped and positioned within the first set up zone. The procedure can then be repeated and/or reversed as required depending on the variation of machining requirements between successive parts. In the preferred form the first set up zones are termed the leading side set up zones and the second set up zones the trailing side set up zones, such that infeed to the station is always to the leading side and outfeed from the trailing side. However, in other embodiments bidirectional processing can be facilitated.

Preferably, means are also provided for optional transfer of finished machine components from a set up zone to a holding zone prior to outfeed from the station.

In the preferred form, separate pick and place transfer means are associated with each of said first and second set up zones so as to operate independently on either side of the intermediate machining zone to transfer components between the infeed/outfeed conveyors, set up zones and holding zones.

In yet a further preferred form, the station comprises two lines, that is two parallel first set up zones, two parallel second set up zones and at least one intermediate machining zone. Preferably, the machining zones disposed intermediate said two parallel paired set up zones have a plurality of independently operable machining systems therein. In the currently preferred form, vertically offset pairs of milling or machining systems are provided to enable simultaneous machining of upper and lower surfaces of the frame components at a given location along the longitudinal length of the component. Alternatively, the machining systems may be horizontally offset to enable simultaneous machining of either side of the frame components or a combination of vertical acting and horizontally acting machining systems. Ideally, this arrangement is duplicated within the machining zone in a back to back configuration such that there are independent machining system configurations associated with the first set up zones and similarly with the second set up zones.

Optionally two parallel set up zones (eg. two first (leading) or two second (trailing) set up zones) can be associated with a single set of machining systems, the latter being adapted to switch rapidly between the two parallel but spaced apart machining zones associated with the two set up zones. This significantly reduces the total number of machining systems required, whilst still providing flexibility to the system by controlling to facilitate the set up of a new component in one of said set up zones whilst a further component may be undergoing operations within the parallel set up zone.

In a preferred form each upper and lower machining system comprises a high speed machining head mounted for movement on three perpendicular axes including an 'x' axis (also referred to as an 'a' axis) that extends transversely horizontal to the feed direction of frame sections, a vertical 'z' axis, and a 'y' axis that extends parallel to the feed direction. In one embodiment movement in the 'y' direction is effected by mounting the machining head for eccentric rotation within the 'x', 'y' plane. This assists rapid transfer of the heads between adjacent machining zones, by combining rotation of the head about a spaced fulcrum, whilst simultaneously performing a translatory movement in the 'x' direction.

Preferably the transport means includes a gripper and feed arrangement and an associated means to directly or indirectly register against a datum on the cut length of frame section. In one form the registration means comprises a resiliently biased end stop associated with the gripper which has a contact sensor. When a leading edge of a frame section is against a fixed stop and the gripper released, the feed arrangement can be indexed forward until the resilient end plate fully abuts the trailing edge of the frame section and contact is registered via the sensor. Coupling the gripper with a feed mechanism incorporating a linear encoder or the like enables subsequent accurate repositioning of the frame section.

In the preferred form, the same gripper and end stop configuration on the trailing side has the additional feature of being able to selectively lock the resilient end stop so as to act as a rigid but variably positionable end stop.

Desirably, retractable fixed stops are also provided within the machining zones such that the machining systems may be positioned using the cut end of a section as a datum.

Preferred forms of the various aspects of the invention will now be described, by way of example only, with reference to the accompanying drawings in which.

Figure 1:
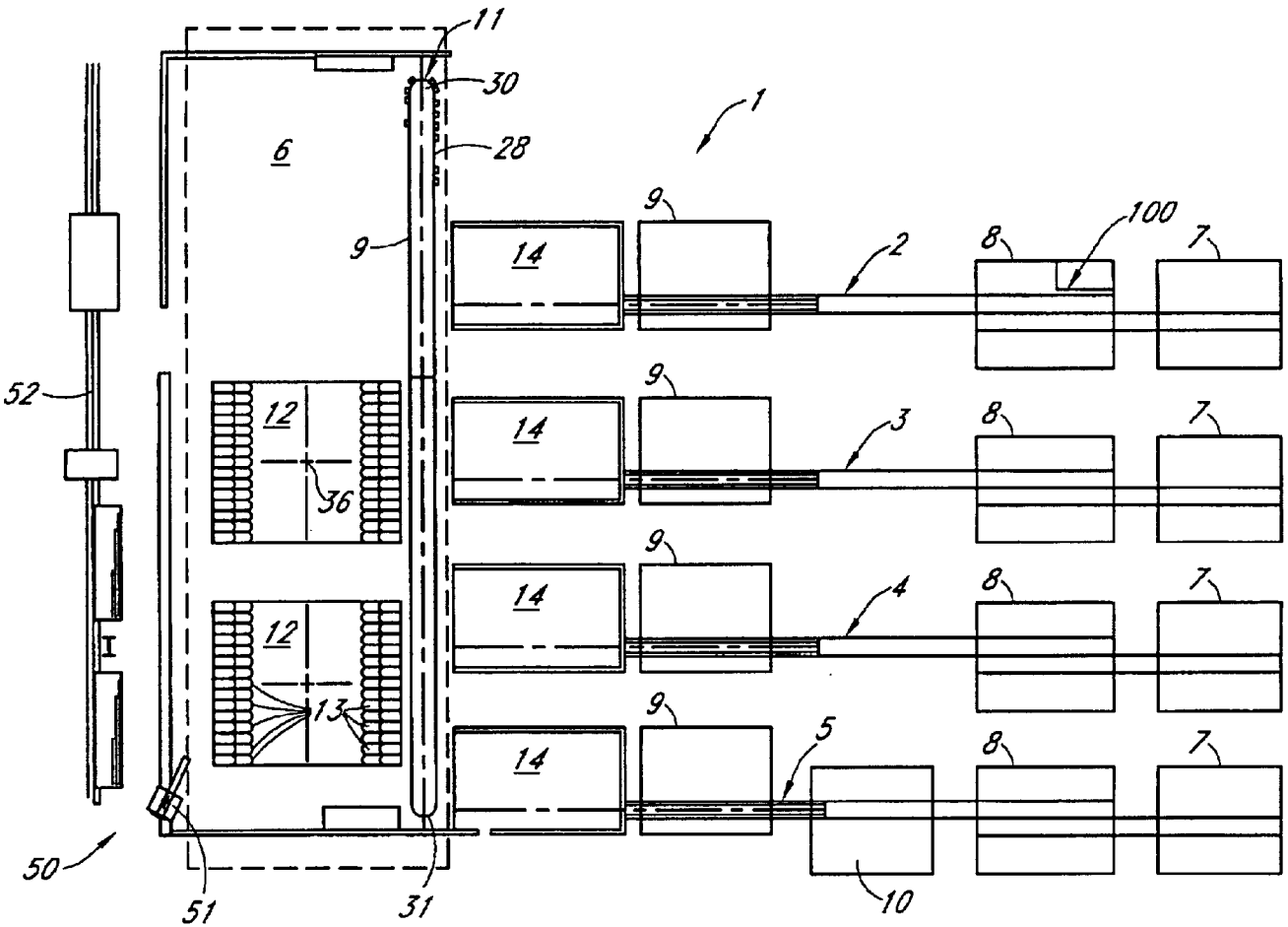
FIG. 1 is a schematic plan representation of a first embodiment manufacturing system in accordance with the second aspect of the invention incorporating a collator in accordance with the first aspect of the invention.

Referring first to FIG. 1, there is shown a first embodiment automated manufacturing system 1 for manufacturing window and door frame components from stock lengths of aluminum section and collating these finished components into kits. The manufacturing apparatus 1 includes four component preparation lines marked 2, 3, 4, and 5 respectively. A collating station shown generally at 6 is provided adjacent a downstream end to the frame component preparation lines. Infeed accumulators 7 are provided at the other end of these component preparation lines which are each adapted to receive, store and feed singularly in series stock lengths of longitudinal frame sections. Each preparation line also includes a first cutting station 8 which is adapted to cut the stock lengths of frame sections to predetermined cut lengths for forming into frame components. In one embodiment, the first cutting station 8 includes means 100 to longitudinally index the stock length of frame section to a predetermined location for cutting in a straight cut or mitre cut as required, as well as transfer means to transfer the cut length of frame section to the first conveyor means.

In the first embodiment illustrated in FIG. 1, preparation lines 2, 3 and 4 also each include an end operation station 9 that is set up to form, punch and/or otherwise machine one or both ends of the cut frame sections in accordance with predetermined requirements, to thereby form the cut frame elements into finished components. The fourth frame preparation line also includes a centre operation station 10 for forming, punching or similarly otherwise cutting each of the cut frame sections at locations between its ends. In a preferred second embodiment, an operations station is provided that can operate on the ends and intermediate portions of the frame sections and this is described in more detail in reference to FIGS. 8 to 13.

The preferred collating station 6 in accordance with a second aspect of the invention has two key components. These are the distributor conveyor 11 and carousel 12, the latter having thereon a plurality of collating pockets 13 that are adapted to receive and contain a set of frame components required in a kit. It should be noted that whilst the carousel arrangement is currently preferred, other means of providing support for a series of collating receptacles may be similarly suitable.

At the downstream end of each of the frame preparation lines, finished frame component transfer means are provided in the preferred form of transfer conveyor and stand up mechanisms shown generally at 14, the detailed configurations of which are shown in FIGS. 2, 3, 4 and 7. In the preferred forms, all conveyors intermediate the cutting and collating stations comprise a series of distinct conveyors as part of the zone transfer process. In this way the position of each component at any time is readily determined and selected conveyor sections can be stopped independently of others to allow accrual of components in a buffer type arrangement when required.

Figure 2:
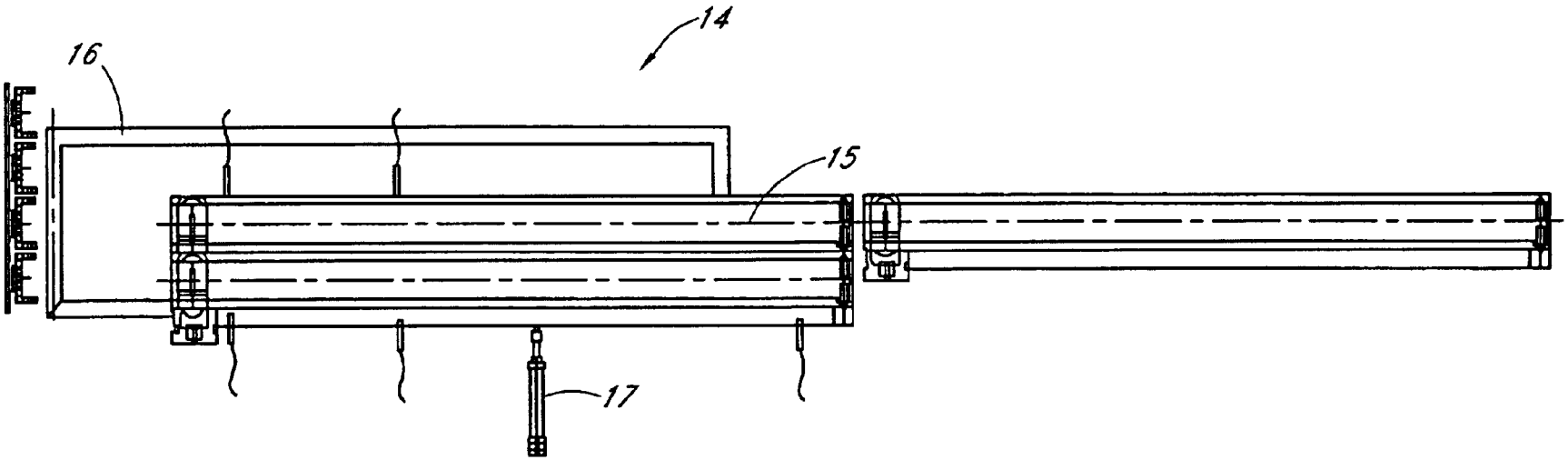
FIG. 2 is a schematic plan view of the twin conveyors forming part of the mechanism for transfer of the finished frame components from the frame component preparation line to the collator.
Figure 3:
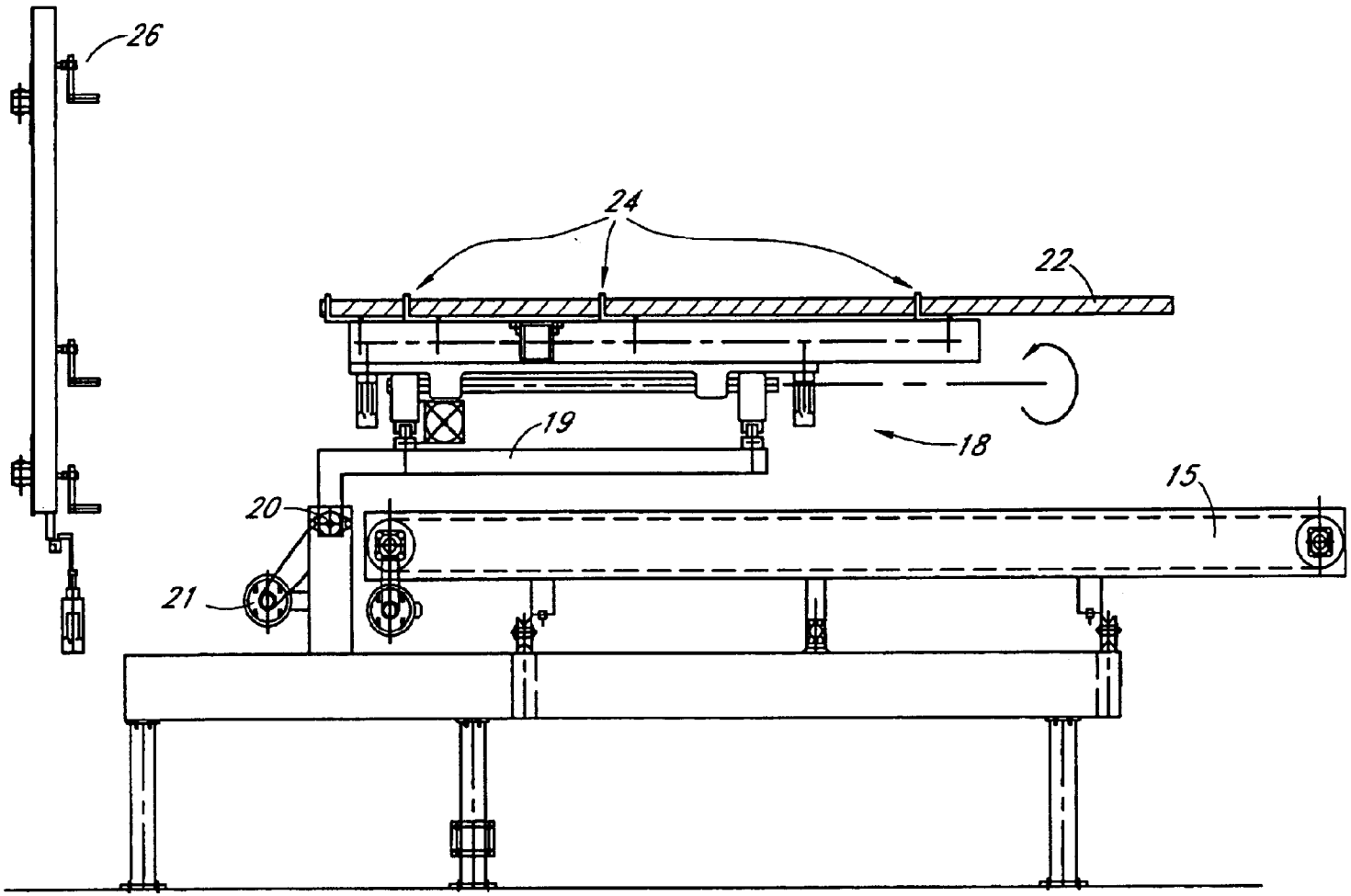
FIG. 3 is a side view of a stand up mechanism used to transfer the finished frame components from the twin conveyor system shown in FIG. 2 to the distributor conveyor that forms part of a first embodiment collator in accordance with the first aspect of the invention, the stand up mechanism being illustrated in the horizontal orientation.
Figure 4:
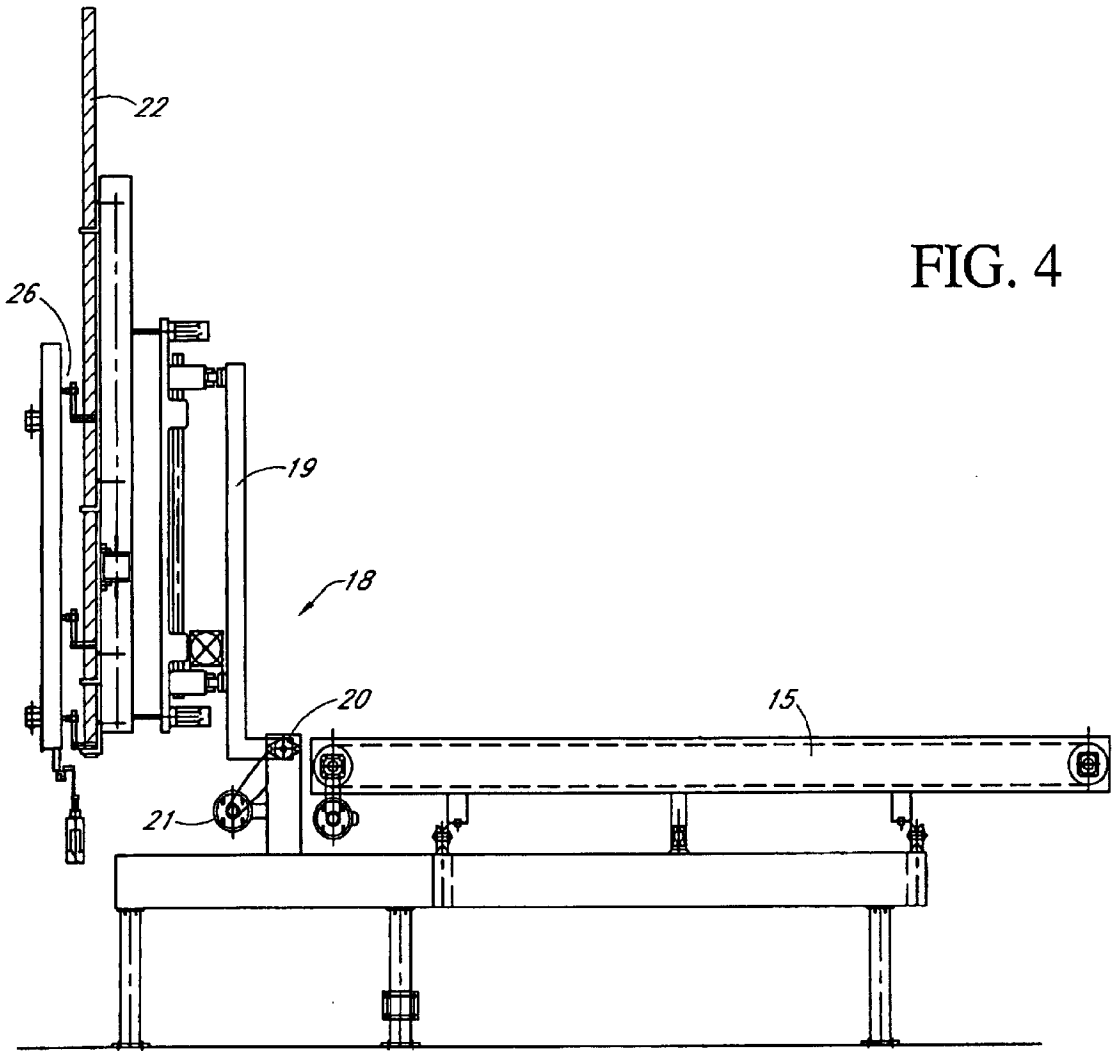
FIG. 4 illustrates the stand up mechanism shown in FIG. 3 in the vertical orientation.

Turning next to FIG. 2, the twin load conveyor arrangement 15 can be seen more clearly. The twin conveyor 15 is mounted on a shuttle at 16 which is operable via cylinder 17 to move transversely to the main line so as to be able to sequentially receive two finished frame components in parallel.

Disposed above the load conveyers 15 is the stand up mechanism shown generally at 18. This mechanism includes a main lifting arm 19 which is pivotally mounted at a proximal end 20 for selective rotation through an arc of approximately 90–30° in a generally vertical direction via a drive operated by motor 21. For convenience, the arm is illustrated as in FIG. 4 as finishing in a vertical orientation, where in the preferred form the full travel is approximately 105°, such that the transfer arm and associated finished frame component 22 is disposed at the end of the lifting operation at approximately 15° off vertical.

Once operation of the system commences, each of the stock lengths in the accumulators are then fed sequentially to the preparation lines 42, 3, 4, and 5 for the first operation at the cutting stations 8. In accordance with the programme the requisite square or mitre cuts are then made and the scrap is automatically removed off line, the cut components then proceeding to the next stations for further operations as required.

Figure 5:
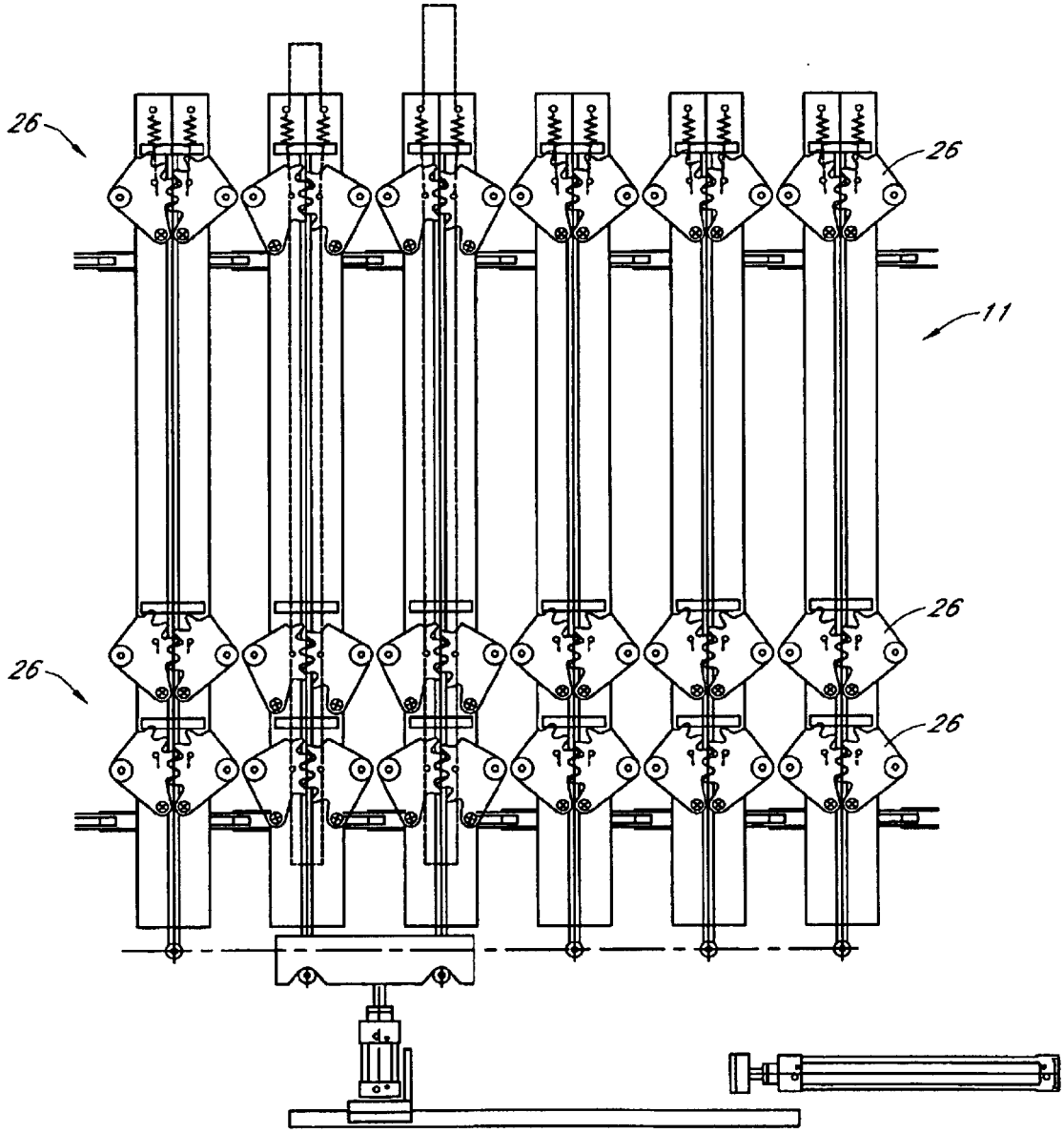
FIG. 5 is a front view of part of the distributor conveyor illustrating the frame component gripper mechanism.

Mounted on the lifting arm 19 is a gripper mechanism 24 which is itself mounted for rotation about its longitudinal axis through at least 180° to facilitate inversion of the finished frame component after lifting from the twin load conveyors 14 for presentation to the gripper means 24 of the distributor conveyor 11. The distributor conveyor gripping means are shown in more detail in FIG. 5.

Figure 7:
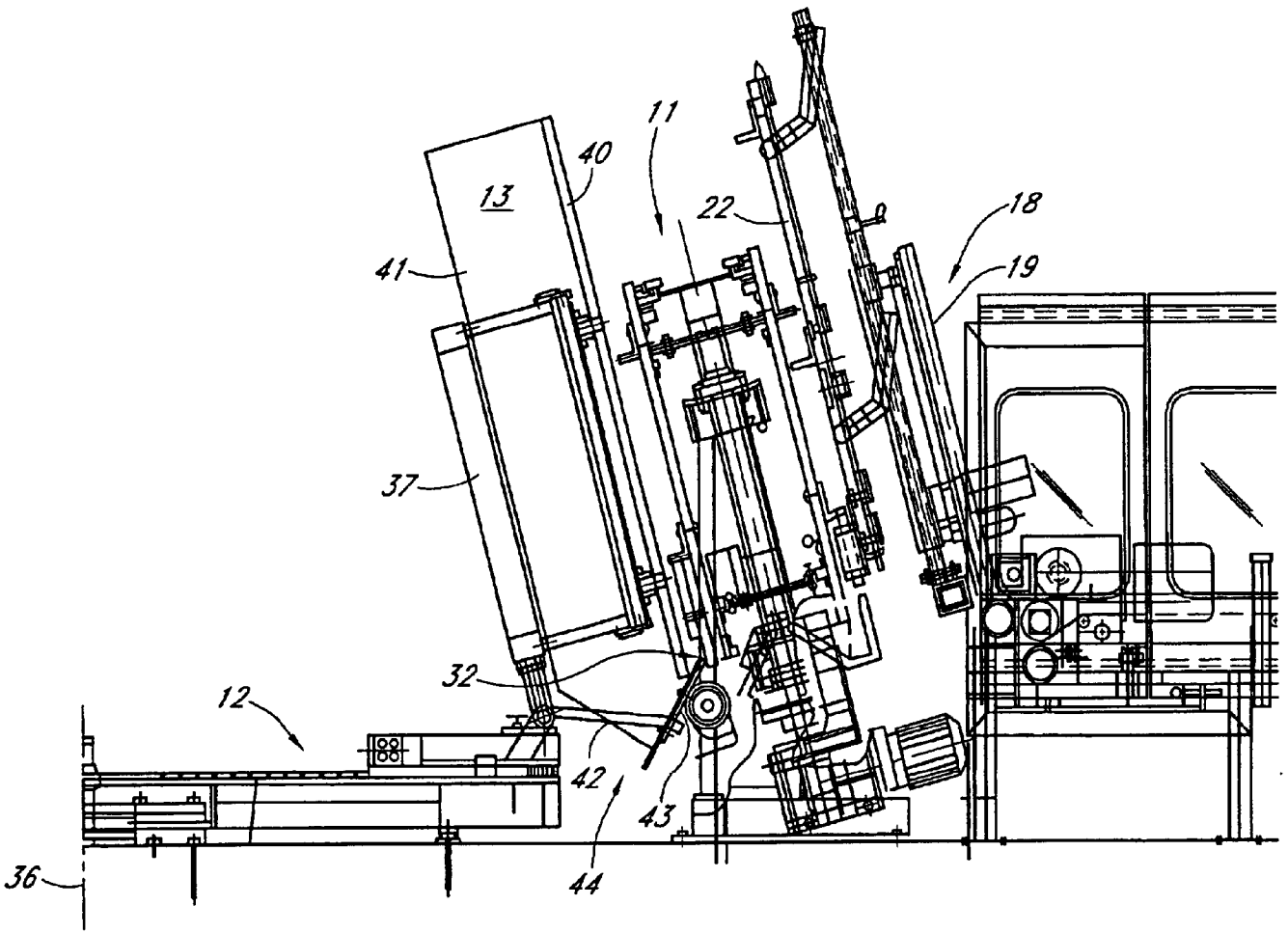
FIG. 7 is a side view illustrating the physical interaction of the stand up mechanism, distributor conveyor and carousel collator pockets.

In this regard the distributor conveyor 11 is a continuous loop conveyor as shown in FIG. 1 having thereon a plurality of gripping devices 26. The distributor conveyor has two parallel sides 28 and 29 intermediate end portions 30 and 31 and is generally inclined along an axis extending between the parallel sides as is best illustrated in FIG. 7. In this manner, the conveyor is conveniently disposed on the one side to readily receive the cut frame components from the stand up mechanism and yet on the other side facilitate automated controlled releasing of the finish frame components into the collating bins.

To assist in the unloading of the components from the gripper means 26 and feeding into the pockets 13, rollers 32 are provided below each set of grippers on the distributor conveyor.

Figure 6:
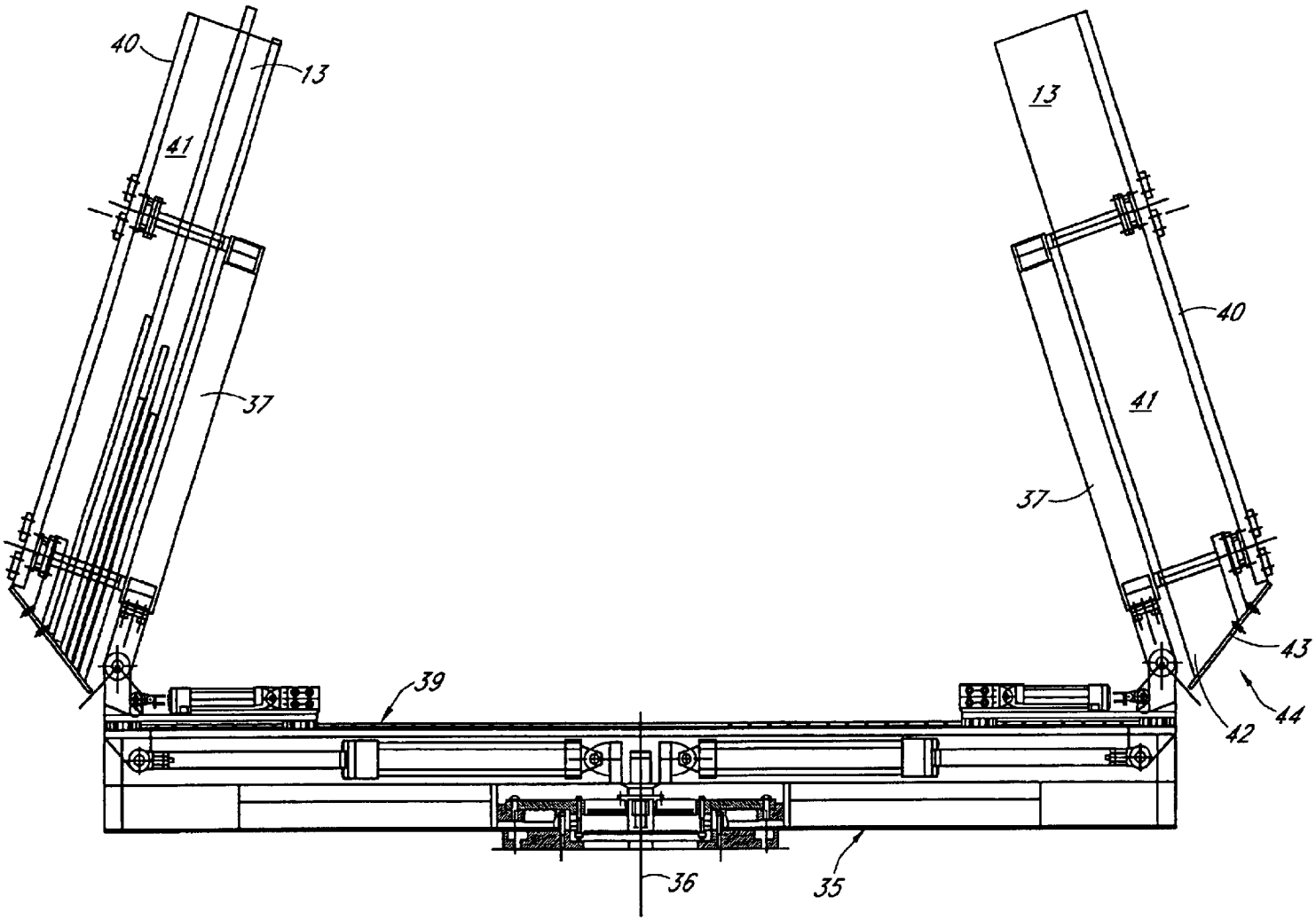
FIG. 6 is a side view of a first embodiment carousel forming part of a collator according to the invention.

As can be seen best from FIGS. 1, 6 and 7, the carousel 12 comprises a base 35 which is rotatable about a central axis 36. Mounted to the base are two frames 37 each adapted to support a single row of collating pockets 13. Each of these frames 37 is mounted on a transverse slide 180° apart, the slide enabling the frames to move toward each other so as to reduce the space required for rotation of the carousel about its central axis 36, and then away from each other to return to the loading and unloading positions as shown in the drawings.

The collator pockets 13 are preferably of a sling type construction having parallel longitudinal edge supports 40 between which extends a flexible material 41 that forms the pocket, this material being shaped at a lower end 42 to define in combination with an end feed guide plate 43 a closed end portion 44.

In use, information regarding work orders for a plurality of different window sets is fed into the central computer control system which then determines the optimum distribution of work between the lines based on ensuring not only that all required operations on each component is completed, but to optimise materials usage and minimise production times by ensuring the work load to all lines is as evenly distributed as possible. This is achieved via some fairly complex software, the details of which have not been described herein.

In accordance with the manufacturing schedule produced by the computer programme, the selected surface finished stock lengths of window extrusion are fed to the various infeed accumulators 7 in the order and allocation established by the programme.

Once operation of the system commences, each of the stock lengths in the accumulators are then fed sequentially to the preparation lines 1, 2, 3 and 4 for the first operation at the cutting stations 8. In accordance with the programme the requisite square or mitre cuts are then made and the scrap is automatically removed off line, the cut components then proceeding to the next stations for further operations as required.

In this regard those components requiring some form of centre operation will be processed on preparation line 5. Similarly, components requiring end operations will be diverted from the main line through one of the end operation stations 9. Preferably, each end operating station includes transfer means to index the cut lengths of frame section in a direction firstly transverse then parallel to that of the conveyor means in a square wave formation away from the conveyor to a first series of sub-stations at which separate end operations can be formed progressively on one respective end of a cut length of frame sections. Each station 8 also includes means to then transfer the cut length to a second series of sub-stations for equivalent operations on the opposing end of the cut frame sections.

Once all the centre punching, cutting and end operations have been completed, the finished frame components are delivered to the twin load conveyors 15, the shuttle operating transverse to the conveyor feed direction to enable sequential parallel loading of two cut components. In this manner the twin conveyors act as a buffer thereby halving the required cycle frequency of the stand up mechanism.

It will be appreciated that the entire system works on a zone transfer principle, preferably in cycle steps of around 6 to 8 seconds. Accordingly, every two cycles, the stand up mechanism operates to firstly pick up any finished frame components that may have been loaded on the twin load conveyors with the gripper mechanism 24 and then rotate each of these components through 180° for presentation to the gripper means 26 of the distributor conveyor 11. As the distributor conveyor is preferably in continuous step wise motion and it is undesirable to hold up the process while the components are loaded onto the distributor conveyor, the stand up mechanism is mounted on rails parallel to the distributor conveyor and configured to track the motion of the distributor conveyor until the transfer has been completed.

Once the components are secured by the gripper devices 26 of the distributor conveyor, the components remain on the conveyor until they are in line with the predetermined pockets 13 on the carousel 12. In this regard the computer will be tracking all components entering the system such that the collating is entirely automatic. Once aligned with the required pocket, the gripping devices are released and the component drops on to transfer roller 32 and falls gently into the pocket 13 aided by the pocket infeed guide plate 43. Careful configuration of the roller 32, vertical inclination of the distributor conveyor 11 and inclination and frictional resistance of the guide plate 43 is needed to control the gentle transfer of the components into the pockets. This process is made difficult due to the significant variation in the centres of gravity of different components of varying length and section. Accordingly, the roller 32 helps deflect the long slender components out into the pocket, and the inclined infeed guide plate 43 takes the energy out of the parts as they fall. This ensures the parts are not damaged when impacting other components that may already be in the pocket.

When the preparation operations have been completed and the finished components deposited in the collating pockets, the pocket support frames 37 retract toward each other on transverse slides 39 in order to reduce the overall foot print of the carousel prior to rotation within the confined space provided between the distributor conveyor and the unloading station shown generally at 50.

After rotation has been completed, a new manufacturing cycle can commence while the contents of each of the full pockets 13 in the rotated row are emptied for subsequent packaging and distribution.

In this regard, several methods of removing the kit of components from the pockets have been proposed. In one arrangement, the row of pockets are lowered to a horizontal orientation and emptied manually. In another arrangement, a robot such as that shown at 51 is used to lift the entire pocket by the edge supports 40 and place this on a separate conveyor 52 where the kits of components are then automatically bundled, packaged and strapped. In yet another arrangement the pockets are optionally fixed and emptied manually.

In another embodiment of the collator not presently illustrated, the carousel is replaced by a series of slide tables adapted to receive a plurality of components that are simply pushed on to the table by an appropriate transfer mechanism.

Similarly, in yet another embodiment, the distributor conveyor is arranged in a horizontal orientation and the collator pockets are disposed below so that the components can drop directly into each pocket as required. Flexible retracting flaps may be attached to the distributor conveyor to ensure the components are placed without causing damage to previously loaded components.

Turning next to FIGS. 8 to 11 there is shown a second embodiment automated frame component manufacturing apparatus incorporating a preferred second embodiment finishing operations station in accordance with the third aspect of the invention. As the differences relate primarily to the operations station, wherever possible like reference numerals will be used to denote features corresponding to those previously described.

Figure 8:
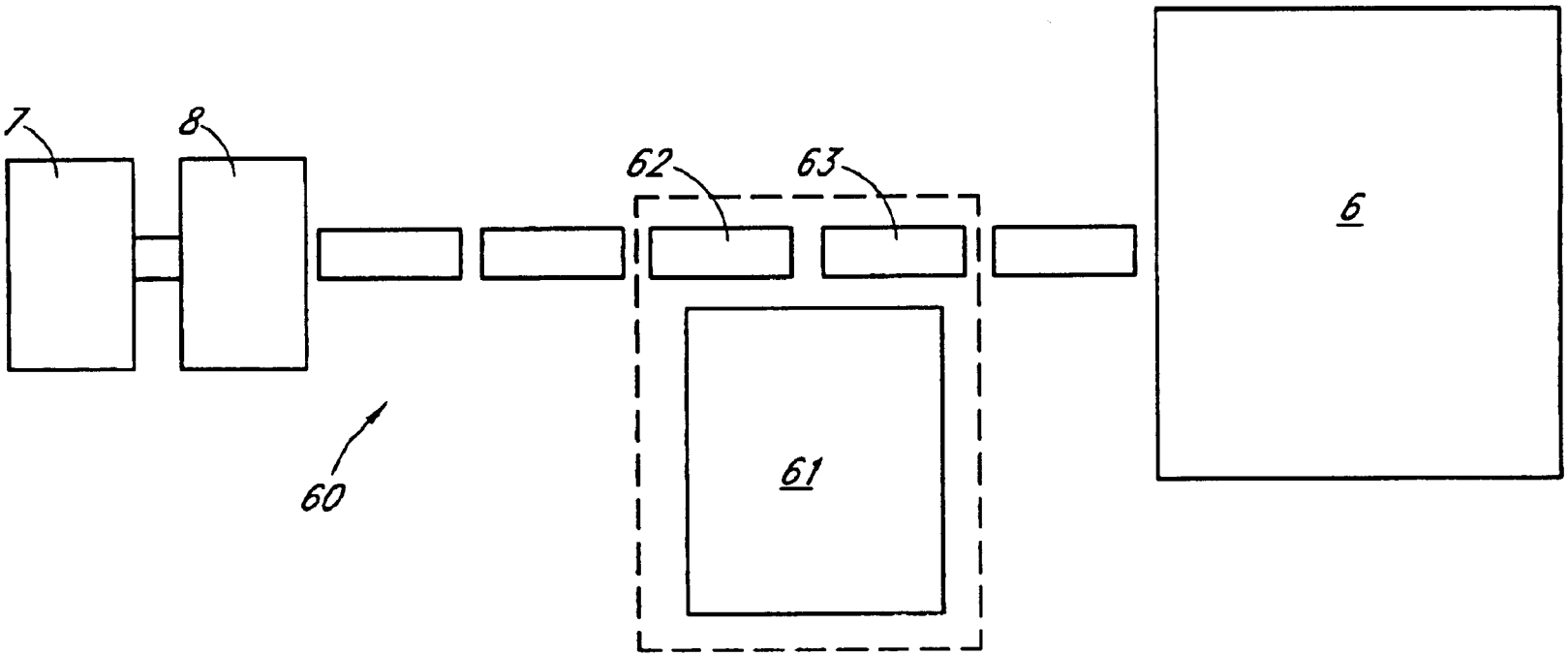
FIG. 8 is a schematic plan representation of a second embodiment manufacturing apparatus in accordance with the second aspect of the invention.

Referring firstly to FIG. 8 it can be seen that the automated manufacturing system 1 has in this example only one component preparation line marked generally at 60. This extends from a cutting station 8 to a collating station 6 which may optionally be of the same configuration as previously described with reference to FIGS. 1 to 7.

The main variation from the first described embodiment is that this preparation line 60 includes a single finishing operations station intermediate the cutting and collating stations. This is in the form of a machining station 61, which is capable of performing machining operations on the ends and intermediate portions of the cut frame sections, thereby replacing both the ends operation station 9 and centre operation 10 shown in FIG. 1.

The preparation line 60 includes an operations infeed conveyor 62 and an operations outfeed conveyor 63 which are arranged serially so as to be directly in line between the cutting station 8 and the collating station 6.

The machining station 61 is aligned with, but transversely offset from, conveyors 62 and 63, the region adjacent the infeed conveyor being referred to as the leading side and that adjacent the outfeed conveyor as the trailing side.

On the leading side two parallel leading set up zones are provided 65 and 66, with corresponding paired trailing set up zones 67 and 68 being located on the trailing side, a machining zone 69 located centrally between the two sides.

Each set up zone includes a gripper arrangement 70 that is mounted on a screw mechanism 71 with an associated linear encoder (not shown). Provided within the jaws of each gripper 70 is a spring mounted end stop mechanism 73 with contact sensor which registers against the relevant end of a cut section. On the trailing side these end stop mechanisms are selectively lockable to act as rigid but movable datums when required. Adjacent each of the parallel sets of leading set up zones and trailing set up zones, are corresponding holding zones 74 and 75.

The machining zone 69 includes four sets of clamping arrangements 76 to 79, two associated with each of the parallel pairs of leading and trailing set up zones, so that for each of the two lines there are two clamping arrangements set up in back to back configuration, ie 76 and 77 for the first line and 78 and 79 for the second line. Associated with each of the four clamping arrangements is a retractable back stop 80.

Also included within the machining zone are four machining systems 81, that is upper and lower systems on the leading side, and the same arrangement on the trailing side. Details of the machining systems are set out after the general description of operation of the system.

Pick and place robots 82 and 83 are provided on the leading and trailing sides respectively, to transfer the components between the set up zones, holding zones and infeed and outfeed conveyors.

Also associated with the station are control means in the form of a PLC shown generally at 85. This may be the main system controller or a dedicated controller that interacts with the main system controller.

In use cut frame components requiring end machining are picked up from the infeed conveyor 62 by the robotic device 82 and when possible placed directly into one of leading set up zones 65 or 66. If the scheduled set up zone is occupied, the component may be temporarily stored in one of the associated holding zones. Once in the set up zone they will then be gripped by the associated gripper 70 and indexed toward the adjacent clamping device 76 or 78 until the cut leading edge hits the retractable back stop 80. The associated upper and lower machining systems will then be controlled using the back stop as a datum. The section is then clamped and the end machined as required.

Once machining at that end is completed, the clamps are released and the back stops retracted so that the section can be indexed through the machining zone using the infeed gripper. If machining is required at say a mid point on the section, as may be required for a lock mechanism for example, accurate positioning is achieved by means of the linear encoder on the gripper feed mechanism. The part is then reclamped, preferably in the leading machine system, and machined accordingly. When finished the clamps are released and the part is indexed again by the infeed gripper.

If machining is then required on the remaining trailing end of the section, the leading edge of the component is gripped by the gripper 70 within the corresponding trailing side set up zone and taken clear of the retracted back stop on the trailing side. Using the outfeed gripper on the trailing side, the part is then reversed back into the same back stop which is now in position, so as to now use the trailing end as the machining datum. This sequencing is varied according to the specific requirements of each component. Once all machining operations are completed, the finished frame component is transferred to the outfeed conveyor and then on to the collator.

Figure 9:
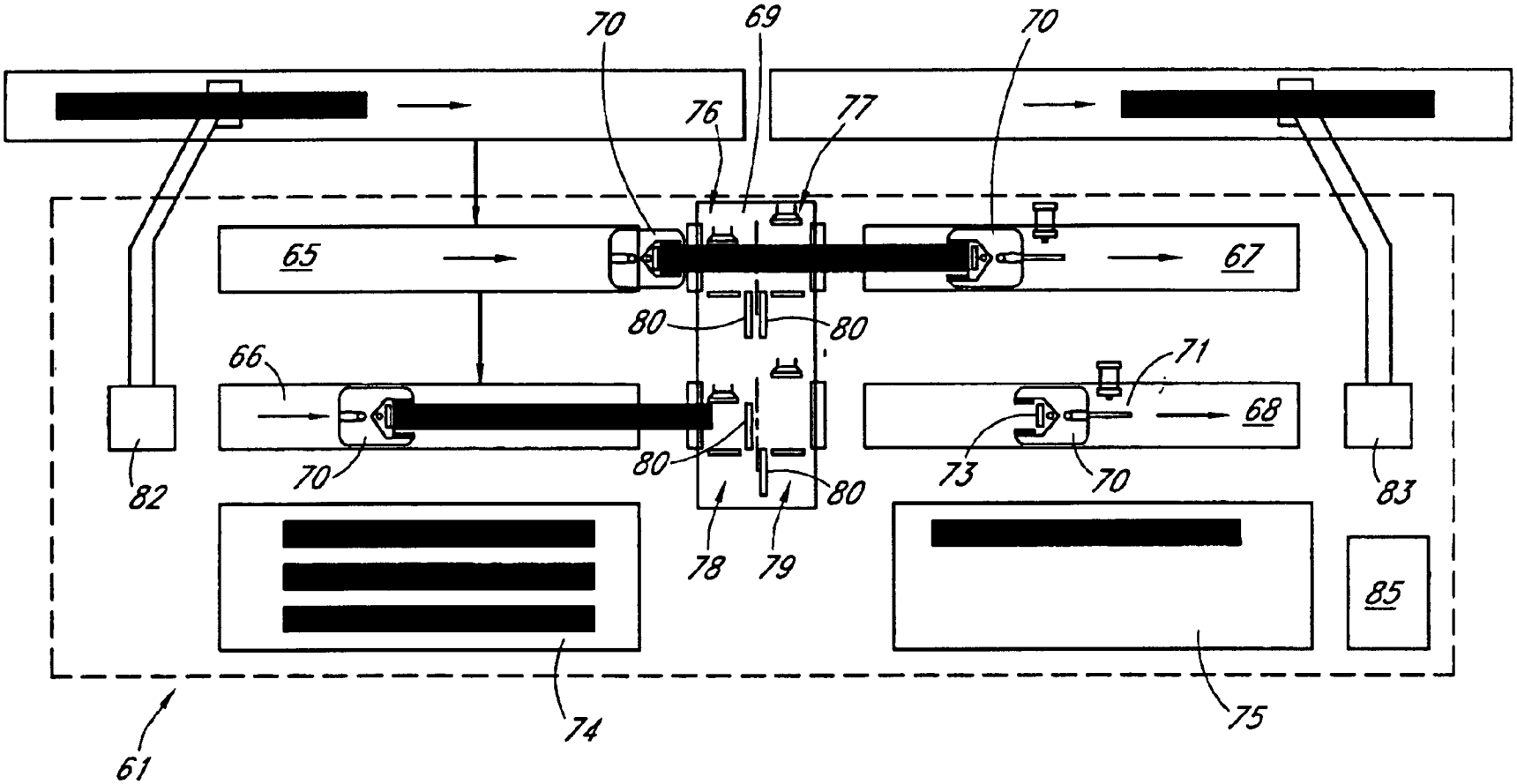
FIG. 9 is a schematic plan representation of a first embodiment finishing operations station in accordance with the third aspect of the invention as shown in FIG. 8.
Figure 11:
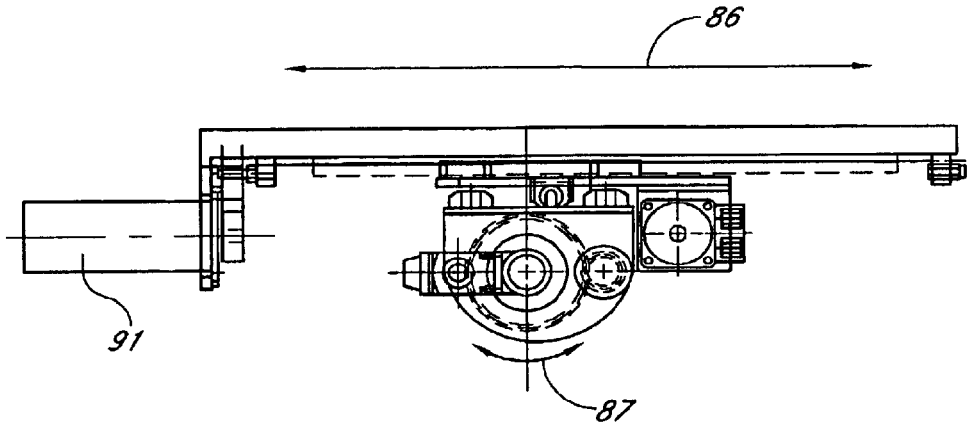
FIG. 11 is a plan view of the machining system shown in FIG. 10.
Figure 10:
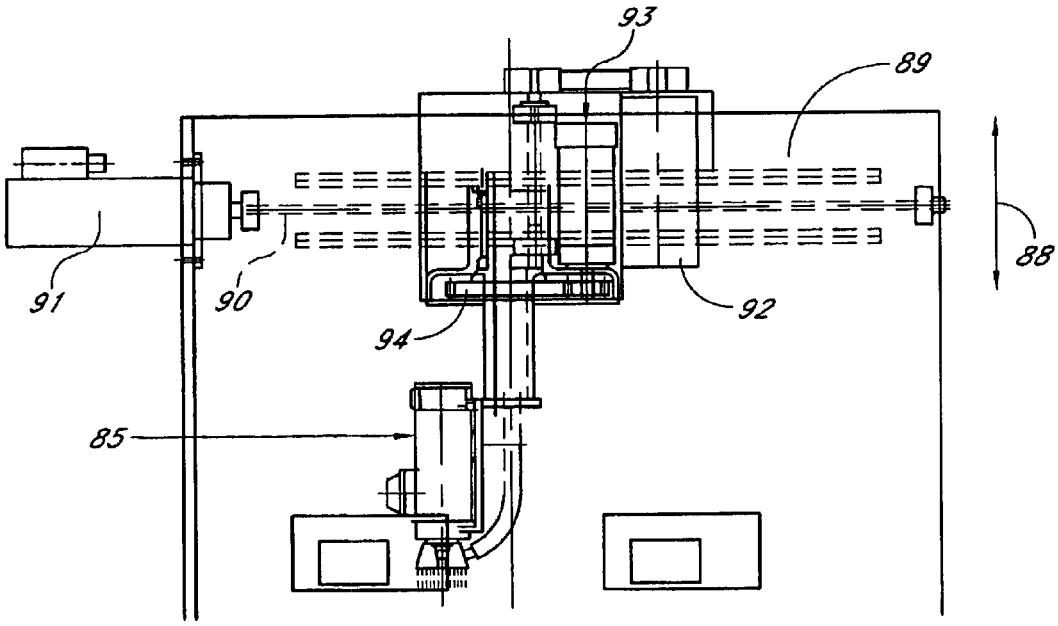
FIG. 10 is an end view of one of the machining systems forming part of the finishing operations station shown in FIG. 9.

Turning next to FIGS. 9 and 10, these show more details of the preferred machining system arrangement shown generally at 81. Each system comprises a high speed machining head 85 mounted for movement about three separate axes marked 86, 87 and 88 which will be described as axes 'a', 'b' and 'z' respectively. Axis 'a' 86 extends transversely horizontal to the feed direction of frame sections through the machining zone and axis extends in a vertical direction. The 'b' axis 87 is that achieved by mounting the machine head 85 for rotation within a horizontal plane. The combination of the 'a' axis 86 and 'b' axis 87 assists rapid transfer of the heads between adjacent machining zones. This is done by combining rotation of the head 85 about a spaced fulcrum, whilst simultaneously performing a translatory movement of that fulcrum in the direction of the 'a' axis.

Motion of the machine head along the 'a' axis 86 is achieved by mounting the machining assembly on a horizontal slide 89, movement being effected by means of a transfer screw 90 powered by servo motor 91. Similarly, movement along the vertical 'z' axis 88 is achieved by a similar arrangement driven by the 'z' axis servo motor 92. Rotation about the 'b' axis is caused by servo motor 93 acting on associated gear train 94. In the preferred form, vertically offset pairs of these machining systems are provided to enable simultaneous machining of upper and lower component surfaces. In other embodiments, the systems may be horizontally offset or include a combination of both.

The particular arrangement described readily facilitates the machining of complex aperture shapes, as well as rapid transfer of the machining heads between the two parallel lines. However, it will be appreciated by those skilled in this field, that numerous other arrangements could be used to the same or similar effect. Similar comments apply in respect of most of the specific components of the operations station including the grippers, feed devices and clamping mechanisms.

It should also be noted that whilst the operations station has been described as forming part of a manufacturing system incorporating cutting and collating capabilities, the station could also be configured to operate as a stand alone unit or with systems other than those described.

However, as can be seen, the manufacturing apparatus in accordance with the second aspect of the invention described herein, particularly when incorporating a collating device according to the first aspect of the invention, provides a highly versatile manufacturing system that minimises stock levels and production lead times. The versatility, flexibility and efficiency of the system is similarly enhanced by optional incorporation of a finishing operations station in accordance with the third aspect of the invention.

Finally, while the invention has been described at this stage with reference to specific examples, it will be appreciated by those skilled in the art that the invention may be embodied in many other different forms.

We claim:

1. An automated manufacturing system for manufacturing kits of frame components of varying lengths and cross sectional shape from stock lengths of frame sections, said apparatus including:

at least one frame component preparation line, wherein said at least one frame component preparation line includes a first cutting station adapted to cut said stock lengths of frame sections to predetermined cut lengths for forming into frame components and conveyor means to transfer cut frame sections to said collating station for grouping into kits;

a collating station for grouping said frame components into kits, wherein said collating station comprises a collator for grouping finished frame components of varying lengths and cross sectional shape into kits, said collator including a frame component receiving station, a collator station defining a plurality of collating receptacles each adapted to receive a kit of said frame components, and first transfer means to selectively transfer each of said frame components from said receiving station to a predetermined one of said receptacles of said collating station;

wherein the frame component receiving station and first transfer means are combined in the form of a programmable distributor conveyor that receives the finished frame components and then selectively deposits each of them into a predetermined one of the collator receptacles:

wherein the distributor conveyor is oriented to receive and convey the finished frame components at an angle of approximately 15° off the vertical, such that the side adjacent the preparation lines is inclined away from the preparation line to assist the step of receiving the finished components, and on the remote side is inclined toward the collator to assist release of the frame component into the collator receptacles.

2. An automated manufacturing system for manufacturing kits of frame components of varying lengths and cross sectional shape from stock lengths of frame sections, said apparatus including:

at least one frame component preparation line, wherein said at least one frame component preparation line includes a first cutting station adapted to cut said stock lengths of frame sections to predetermined cut lengths for forming into frame components and conveyor means to transfer cut frame sections to said collating station for grouping into kits;

a collating station for grouping said frame components into kits, wherein said collating station comprises a collator for grouping finished frame components of varying lengths and cross sectional shape into kits, said collator including a frame component receiving station, a collator station defining a plurality of collating receptacles each adapted to receive a kit of said frame components, and first transfer means to selectively transfer each of said frame components from said receiving station to a predetermined one of said receptacles of said collating station;

wherein the collator station has thereon a plurality of collating bins each adapted to receive a set of frame components required to make up a kit for a particular frame; wherein the collating bins are in the form of pockets disposed in a generally vertical orientation for loading and unloading the frame components:

wherein the transfer means include rollers to deflect a lower end of components toward the pocket and the pockets include an inclined component end guide plate to take the energy out of the component as it falls into the pocket.

3. An automated manufacturing system for manufacturing kits of frame components of varying lengths and cross sectional shape from stock lengths of frame sections, said apparatus including:

at least one frame component preparation line, wherein said at least one frame component preparation line includes a first cutting station adapted to cut said stock lengths of frame sections to predetermined cut lengths for forming into frame components and conveyor means to transfer cut frame sections to said collating station for grouping into kits;

a collating station for grouping said frame components into kits, wherein said collating station comprises a collator for grouping finished frame components of varying lengths and cross sectional shape into kits, said collator including a frame component receiving station, a collator station defining a plurality of collating receptacles each adapted to receive a kit of said frame components, and first transfer means to selectively transfer each of said frame components from said receiving station to a predetermined one of said receptacles of said collating station;

wherein said collating station has thereon a plurality of collating bins each adapted to receive a set of frame components required to make up a kit for a particular frame; wherein the collating bins are in the form of pockets disposed in a generally vertical orientation for loading and unloading the frame components;

wherein the pockets are in the form of sling holders which are optionally readily removable from the collator.

4. An automated manufacturing system for manufacturing kits of frame components of varying lengths and cross sectional shape from stock lengths of frame sections, said apparatus including;

at least one frame component preparation line, wherein said at least one frame component preparation line includes a first cutting station adapted to cut said stock lengths of frame sections to predetermined cut lengths for forming into frame components and conveyor means to transfer cut frame sections to said collating station for grouping into kits;

a collating station for grouping said frame components into kits, wherein said collating station comprises a collator for grouping finished frame components of varying lengths and cross sectional shape into kits, said collator including a frame component receiving station, a collator station defining a plurality of collating receptacles each adapted to receive a kit of said frame components, and first transfer means to selectively transfer each of said frame components from said receiving station to a predetermined one of said receptacles of said collating station;

wherein said collating station has thereon a plurality of collating bins each adapted to receive a set of frame components required to make up a kit for a particular frame, wherein the collator is in the form of a carousel containing two sets of collating bins each in the form of a row of component receiving pockets, each row being mounted 180° apart, the carousel being rotatable about an axis between said sets of pockets such that one set of pockets can be positioned for loading or receiving the frame components, while the other is positioned for unloading of the collated kits of components.

5. An automated manufacturing system according to claim 4 wherein each set of pockets is also mounted for horizontal movement toward each other prior to and for the rotation cycle.

* * * * *

UNITED STATES PATENT AND TRADEMARK OFFICE

CERTIFICATE OF CORRECTION

PATENT NO. : 6,860,181 B2
DATED : March 1, 2005
INVENTOR(S) : Peter Aubourg et al.

It is certified that error appears in the above-identified patent and that said Letters Patent is hereby corrected as shown below:

Column 13,
Line 22, after "receptacles" delete ":" and insert -- ; --.
Line 58, afer "components" delete ":" and insert -- ; --.

Column 14,
Line 32, after "including" delete ";" and insert -- : --.

Signed and Sealed this

Eighteenth Day of April, 2006

JON W. DUDAS
*Director of the United States Patent and Trademark Office*